United States Patent [19]

Szecsi

[11] 4,277,765

[45] Jul. 7, 1981

[54] DEVICE FOR COOLING A SUPERCONDUCTIVE RESONATOR AND METHOD OF MAKING THE DEVICE

[75] Inventor: Laszlo Szecsi, Karlsruhe, Fed. Rep. of Germany

[73] Assignee: Kernforschungszentrum Karlsruhe GmbH, Karlsruhe, Fed. Rep. of Germany

[21] Appl. No.: 18,425

[22] Filed: Mar. 7, 1979

[30] Foreign Application Priority Data

Mar. 8, 1978 [DE] Fed. Rep. of Germany ..... 2809913

[51] Int. Cl.[3] ..... H01P 7/06; H01P 11/00

[52] U.S. Cl. ..... 333/99 S; 29/599; 29/600; 333/227

[58] Field of Search ..... 333/228, 229, 248, 99 S; 29/599-601; 228/193-196; 174/15 R, 15 CA, 15 C, 15 S

[56] References Cited

U.S. PATENT DOCUMENTS 3,512,581 5/1970 Lawton ..... 174/15 S X

FOREIGN PATENT DOCUMENTS 1927825 12/1970 Fed. Rep. of Germany .

OTHER PUBLICATIONS

Halbritter-"High-Frequency Resonators and Lines", Journal of Applied Physics, vol. 42, No. 1, Jan. 1971; pp. 82-87.

ALM-"Design Feature Space-Age Bonding Techniques, Part 1, Diffusion Bonding", Mechanical Engineering, May 1970; pp. 24-32.

*Primary Examiner*—Marvin L. Nussbaum

*Attorney, Agent, or Firm*—Spencer & Kaye

[57] ABSTRACT

A device for cooling a superconductive resonator has a tube for containing liquid coolant and a diffusion weld connecting an outer face of the tube with the resonator wall in a heat-exchanging relationship therewith.

10 Claims, 7 Drawing Figures

DEVICE FOR COOLING A SUPERCONDUCTIVE RESONATOR AND METHOD OF MAKING THE DEVICE

BACKGROUND OF THE INVENTION

This invention relates to a device for cooling a superconductive high-frequency resonator with a liquid coolant and further relates to a method of making such a cooling device.

Superconductive resonators are used, for example, for accelerating and deflecting particles. They are advantageous since they operate with significant energy saving. For setting and maintaining the superconductive state, the superconductive structures have to be cooled continuously with a coolant such as liquid helium.

The cooling of high-frequency resonators is known and is achieved either by submerging the superconductive resonator into a bath of liquid helium which is at a temperature of 4.2 K or the resonator vessel is of a dual-wall (jacket) structure filled with liquid helium which is continuously circulated and replaced.

The above-outlined arrangements have a number of disadvantages. Thus, particularly in the immersion process, the resonator vessel, in the inside of which a high vacuum of less than $10^{-8}$ Torr is to be maintained, is exposed to the pressure fluctuations of the helium bath which cause deformations of the resonator and thus lead to undesirable changes in the resonant frequency. Further, a leakage of liquid helium into the resonator can be prevented only by particular structural arrangements for increasing the sealing effect. Although these disadvantages may be, to a large measure, avoided by using a dual-wall resonator, this latter solution is structurally complex and thus leads to high costs.

SUMMARY OF THE INVENTION

It is an object of the invention to provide, for superconductive high-frequency resonators, an improved cooling device which has a simple structure, which can be manufactured at low cost and which is free from the disadvantages inherent in prior art arrangements.

This object and others to become apparent as the specification progresses, are accomplished by the invention, according to which, briefly stated, a tube in which a coolant is circulated, is connected by diffusion welding to the resonator wall in a heat exchanging relationship therewith.

The device which achieves the above-outlined object in an unexpectedly simple manner is made by the following method according to the invention: the cross section of the cooling tube is flattened by the application of pressure at least on that side with which the cooling tube is to engage the resonator wall; the course of the cooling tube is adapted to the shape of the resonator wall with which a diffusion weld-type bond is to be achieved; both the cooling tube and the resonator wall are polished and degreased. Thereafter the resonator wall and the cooling tube are pressed to one another with a predetermined pressure of at least 0.4 bar and during the application of this pressure the components are heated to incandescence for a duration of preferably 2–3 hours at a temperature of approximately 2100 K in a vacuum furnace at a pressure which is equal to or smaller than $10^{-7}$ Torr.

The method of making the cooling device is particularly economical because the end plates of the resonator and the resonator body itself have to be, after their manufacture, heated to incandescence in any case at a high temperature of approximately 2100 K for an extended period of approximately two hours in a high vacuum for the setting of good superconductive properties.

The invention has a number of advantages. Thus, in particular:

(1) A quasi-dual-wall cooling arrangement with a high degree of cooling effect can be obtained without significant additional input of labor, since for this purpose the heat treatment is utilized which is required in any event for the resonator.

(2) The heat due to energy losses in the resonator may be removed without difficulty with a coolant that flows through the cooling pipe.

(3) The closed cooling system is adapted for a forced circulating cooling with an increased cooling effect even at low temperatures of 4.2 K.

(4) A pressure change in the coolant flowing through the conduit system does not alter the resonant frequency of the resonator which has to be maintained during operation at an accurate value.

(5) The sealing of the cooling system can be achieved in a simple manner with respect to the vacuum prevailing in the inside and the outside of the resonator.

(6) The sealing requirements for the seals regarding the devices flanged to the upper face of the resonator for applying and discontinuing the high-frequency energy can be significantly lowered, because the flanges remain entirely out of contact with the liquid helium.

DESCRIPTION OF THE PREFERRED EMBODIMENT

Figure 1:
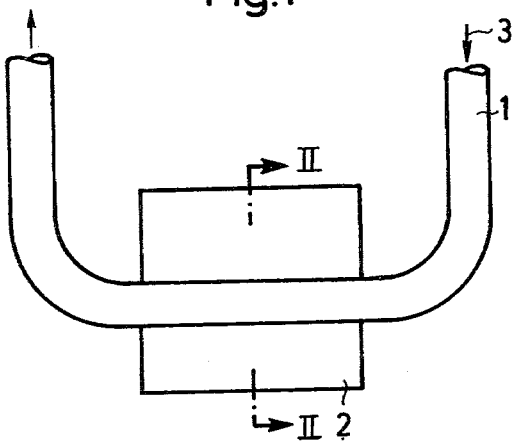
FIG. 1 is a side elevational view of a tube and a sheet member bonded to one another by diffusion welding.
Figure 2:
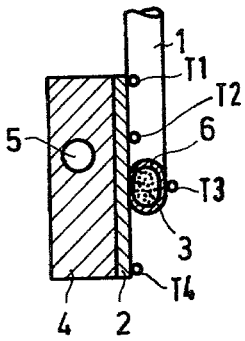
FIG. 2 is a sectional view taken along lines II—II of FIG. 1.
Figure 3:
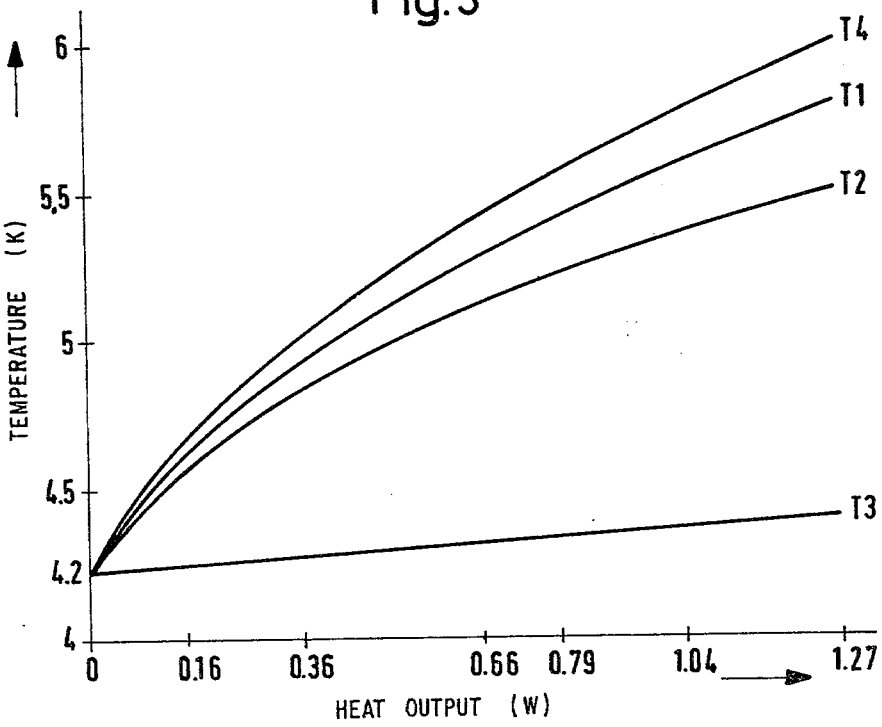
FIG. 3 is a diagram illustrating the temperature sensed at several locations in the zone of the diffusion weld of the components shown in FIGS. 1 and 2, as a function of the heat output.

FIGS. 1 and 2 illustrate a simple testing arrangement for aiding in the plotting of the graphs of FIG. 3, to thus demonstrate the efficiency of the invention. In FIG. 1 there is shown a cooling tube 1 in which liquid helium 3 is circulated and which is attached to a plate member 2 (representing a resonator wall) by diffusion welding. Both components 1 and 2 are superconductive niobium. The sheet 2 has a thickness of 3 mm, the cooling tube 1 has a dimension of 10×1 mm.

Turning now to the sectional illustration in FIG. 2, the sheet member 2 is heat-transmittingly connected with a copper plate 4 for representing the heat due to energy losses that appear in the resonator during operation. The copper plate 4 is connected to an electric heating cartridge 5. The cross section 6 of the cooling tube 1 has the shape of a flattened circle and is heat-transmittingly connected at its flat sides with the sheet component 2 by means of diffusion welding. According to the invention, the diffusion welding process is performed in a high-vacuum furnace where the components 1 and 2, while they are pressed together with a pressing force of 0.4 bar, are submitted to a temperature of 2100 K at a pressure of $10^{-7}$ Torr for a duration of two hours. Prior to the diffusion welding process, the cooling tube 1 and the sheet 2 are polished and degreased at their mutual contacting surfaces.

On the arrangement prepared as discussed above, temperature sensors T1, T2, T3 and T4 are provided for measuring the temperatures as a function of the heat output applied by the heating cartridge 5 during corresponding flow rates of the liquid helium in the cooling tube 1. The measured results are illustrated in the diagram of FIG. 3. These measurements show that at a maximum temperature increase of 1 K, approximately 0.1 W/cm pipe length heat output may be removed, so that this cooling process is, in principle, applicable for resonators where several hundreds Watt surface load is to be assumed.

Figure 4:
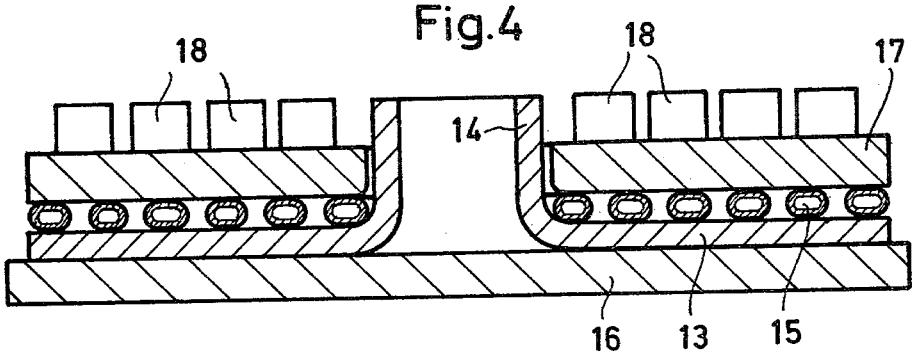
FIG. 4 is a sectional view of a resonator end plate and a device for diffusion welding.
Figure 5:
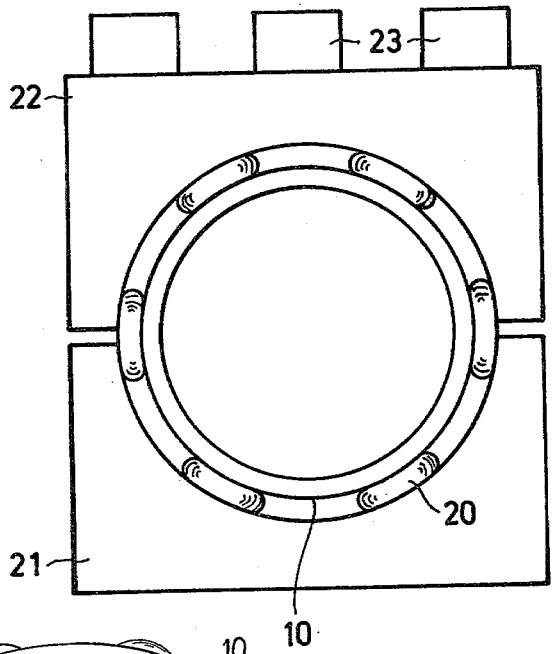
FIG. 5 is an end view of a resonator body and a device for diffusion welding.
Figure 6:
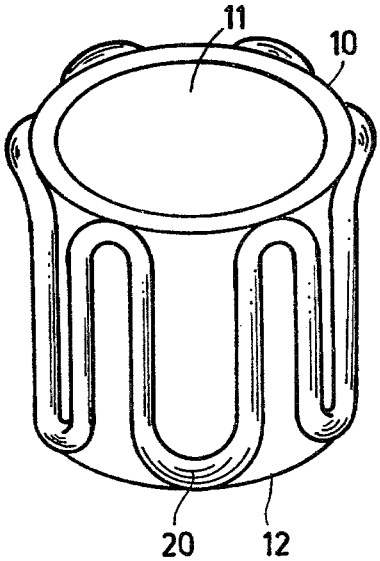
FIG. 6 is a perspective view of a resonator body incorporating a preferred embodiment of the invention.

Turning now to FIGS. 4, 5 and 6, there is shown, in a simplified illustration, an exemplary embodiment of the cooling device according to the invention. The tubular body 10 of the resonator is closed at its ends 11 and 12 with rotationally symmetrical end plates 13 which, in their center, have a nipple 14 for a radiation transmitting tube. A cooling tube 15 of spiral course is firmly connected with the outer face of the end plate 13 by means of diffusion welding, as will be described below. The cross section of the cooling tube 15 is of flattened circular shape so that the contact faces between the cooling tube 15 and the end plate 13 are increased. The end plate 13 and the cooling tube 15 are of niobium. The outer diameter of the end plate 13 is approximately 500 mm, the inner diameter of the radiation transmitting tube is 120 mm, its wall thickness is 3 mm. The original dimension of the cooling tube 15 is 10×1 mm; it is compressed to an outer dimension of 12×7 mm.

For performing the above-noted diffusion welding of the cooling tube 15 to the end plate 13, the latter is positioned on a first niobium plate 16, whose face oriented towards the end plate 13 is roughened by sand blasting. The spiral cooling tube 15 is pressed against the end plate 13 by means of a second niobium plate 17 which is roughened on both sides by sand blasting. For setting a predetermined pressing force, the second niobium plate 17 is loaded by niobium weights 18 which are roughened by sand blasting at their underside.

Turning now to FIGS. 5 and 6, the tubular body 10 of the resonator is provided at its outer side with a meandering cooling tube 20 which extends in a serpentine course essentially parallel to the resonator axis. For bonding the tubular body 10 to the meandering cooling tube 20 by diffusion welding, both components are positioned in a horizontal orientation of the axis of the body 10 into a cradle-like first half shell 21 made of niobium and are covered with a second niobium half shell 22. The inner faces of the shells 21 and 22 are roughened by sand blasting. The pressing force is set by niobium weights 23 which are roughened by sand blasting at their underside. The diffusion welding proper is performed in a manner as described in connection with components 1 and 2 illustrated in FIGS. 1 and 2.

The end plates 13 carrying the spiral cooling tubes 15 are then secured to the respective ends 11 and 12 of the resonator body 10 (carrying the meandering cooling tube 20) in a conventional manner.

Figure 7:
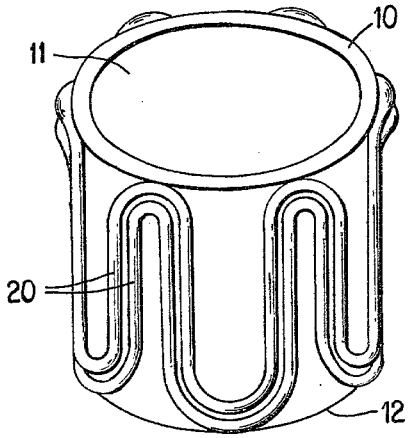
FIG. 7 is a perspective view of a resonator body having two parallel extending meandering cooling tubes.

Turning now to FIG. 7, the tubular body **1*o* of the resonator is provided at its outer side with two meandering cooling tubes 2*o* which extends parallel to one another in a serpentine course essentially parallel to the resonator axis. The liquid flow in this two cooling tubes 2*o*** is oppositely directed.

It is to be understood that the above description of the present invention is susceptible to various modifications, changes and adaptations, and the same are intended to be comprehended within the meaning and range of equivalents of the appended claims.

What is claimed is:

1. In a device for cooling a superconductive resonator with a liquid coolant; the resonator having a rotationally symmetrical cylindrical body closed off at opposite ends by respective end plates; the improvement comprising (a) a first tube for containing liquid coolant arranged externally of said cylindrical body in heat-exchanging contact therewith; said first tube having a meandering course extending generally in the direction of the axis of said cylindrical body;

(b) second tubes for containing liquid coolant arranged externally of each said end plate in heat-exchanging contact therewith; each said second tube having a spiral course extending symmetrically with respect to said axis; and (c) diffusion welds connecting said first tube to said cylindrical body and said second tubes to the respective said end plates.

2. A device as defined in claim 1, wherein at least some of said tubes have a flattened cross-sectional shape at least along their portion oriented towards the component to which they are welded.

3. A device as defined in claim 1, wherein there are provided two meandering first tubes extending parallel to one another about said cylindrical body.

4. A method of making a cooling device for cooling a superconductive resonator with a liquid coolant; the resonator being formed of a cylindrical body and end plates for closing off opposite ends of the cylindrical body; comprising the following steps:

(a) positioning each end plate on a first niobium plate;

(b) positioning a spiral cooling tube, in which the liquid coolant is to be circulated, on the end plate symmetrically therewith;

(c) positioning a second niobium plate on the spiral cooling tube;

(d) subsequent to steps (a), (b) and (c), pressing the spiral cooling tube against the respective end plate with a pressure of at least 0.4 bar by niobium weights positioned on said second niobium plate;

(e) prior to steps (a) through (d), roughening, by sand blasting, the face of said first niobium plate to be oriented towards said end plate, both faces of said second niobium plate and faces of said niobium weights to be oriented towards said second niobium plate; and (f) simultaneously with step (d), heating the asembly formed by said end plate, said spiral cooling tube, said niobium plates and said niobium weights to incandescence at a temperature of approximately 2100 K at a pressure of maximum $10^{-7}$ Torr for a predetermined duration to effect diffusion welding between the spiral cooling tube and the end plate.

5. A method as defined in claim 4, further comprising the step of flattening by pressure the cross-sectional shape of the spiral cooling tube prior to step (d), at least along those portions that are to be bonded to the end plate in step (f).

6. A method as defined in claim 4, further comprising the step of polishing and degreasing the spiral cooling tube and the end plate prior to step (d).

7. A method of making a cooling device for cooling a superconductive resonator with a liquid coolant; the resonator including a cylindrical body; comprising the following steps:

(a) enclosing said cylindrical body and a meandering cooling tube surrounding the cylindrical body, in a multi-part niobium pressing device having a roughened inner face contacting the cooling tube;

(b) pressing the cooling tube against the cylindrical body with a pressure of at least 0.4 by niobium weights positioned on said pressing device and having an underside roughened by sand blasting; and (c) simultaneously with step (b), heating the assembly formed by said cylindrical body, said meandering cooling tube, said pressing device and said niobium weights to incandescence at a temperature of approximately 2100 K at a pressure of maximum $10^{-7}$ Torr for a predetermined duration to effect diffusion welding between the cooling tube and the cylindrical body.

8. A method as defined in claim 7, further comprising the step of flattening by pressure the cross-sectional shape of the cooling tube prior to step (b), at least along those portions that are to be bonded to the cylindrical body in step (c).

9. A method as defined in claim 7, further comprising the step of polishing and degreasing the cooling tube and the cylindrical body prior to step (b).

10. A method as defined in claim 4 or 7, wherein said predetermined duration is between two and three hours.

* * * * *